US009597905B2

(12) United States Patent
Kurosawa

(10) Patent No.: US 9,597,905 B2
(45) Date of Patent: Mar. 21, 2017

(54) INKJET PRINTER

(71) Applicant: Oki Data Infotech Corporation, Chiba (JP)

(72) Inventor: Naoki Kurosawa, Chiba (JP)

(73) Assignee: Oki Data Infotech Corporation, China (JP)

( * ) Notice: Subject to any disclaimer, the term of this patent is extended or adjusted under 35 U.S.C. 154(b) by 0 days.

(21) Appl. No.: 15/182,728

(22) Filed: Jun. 15, 2016

(65) Prior Publication Data

US 2016/0368292 A1 Dec. 22, 2016

(30) Foreign Application Priority Data

Jun. 16, 2015 (JP) ..... 2015-120979

(51) Int. Cl.
*B41J 25/308* (2006.01)
*B41J 2/155* (2006.01)

(52) U.S. Cl.
CPC ..... *B41J 25/3082* (2013.01); *B41J 2/155* (2013.01); *B41J 2202/21* (2013.01)

(58) Field of Classification Search
CPC .... B41J 25/3082; B41J 2/155; B41J 2202/21; B41J 2/045
See application file for complete search history.

(56) References Cited

U.S. PATENT DOCUMENTS 7,591,518 B2 * 9/2009 Murai ..... B41J 19/202 347/37
2010/0067926 A1 3/2010 Akiyama et al.

FOREIGN PATENT DOCUMENTS

| | | | |
|---|---|---|---|
| JP | 2886534 | B2 | 4/1999 |
| JP | 2002-113910 | A | 4/2002 |
| JP | 2007-301447 | A | 11/2007 |
| JP | 2012228778 | A | 11/2012 |
| JP | 2013-067085 | A | 4/2013 |

* cited by examiner

*Primary Examiner* — Thinh H Nguyen
(74) *Attorney, Agent, or Firm* — Panitch Schwarze Belisario & Nadel LLP

(57) ABSTRACT

An inkjet printer includes: a head for ejecting ink to a recording medium; a platen for supporting the recording medium; a conveying unit for conveying the recording medium in a conveying direction; a carriage on which the head is mounted, the carriage moving in a direction perpendicular to the conveying direction; a plate disposed on a side of the carriage and spaced from the platen, the plate deforming due to contact with the recording medium; a sensor fixed to the plate and configured to output a signal in response to deformation of the plate; a position sensor for detecting a position of the carriage; and a controller that, upon detecting contact of the recording medium with the plate based on the signal while the carriage is moving, controls operation of the carriage and head based on a moving direction of the carriage and the position detected by the position sensor.

5 Claims, 6 Drawing Sheets

INKJET PRINTER

BACKGROUND OF THE INVENTION

1. Field of the Invention

The present invention relates to an inkjet printer for recording an image on a recording medium.

2. Description of the Related Art

Inkjet printers are widely used. An inkjet printer ejects ink from an inkjet recording head onto a recording medium to record an image. Ink stored in an ink cartridge is supplied to the recording head. Printers of this type include not only small-sized household printers for recording onto an A4 or A3 size sheet, but also large-sized printers capable of printing onto a wide recording medium having a width of 1 m or greater.

Inks used for recording include various types of inks, such as an ink obtained by dissolving dye in a solvent such as water, a solvent ink obtained by dispersing a pigment in an organic solvent, an ultraviolet curable ink that is cured by ultraviolet rays, and a heat curable ink that is cured by heat.

An inkjet printer includes a carriage on which a recording head is mounted. The carriage reciprocates in a width direction of a recording medium, i.e., main scanning direction. The recording head ejects ink onto the recording medium on a forward path and a backward path to record an image. The recording medium is conveyed in a direction perpendicular to the moving direction of the carriage, i.e., a sub scanning direction. The inkjet printer conveys the recording medium by a predetermined amount at one time, and ejects ink while moving the carriage in the main scanning direction. This operation is repeated to record an image. The predetermined amount is equal to an amount obtained by dividing the length of the recording head by an integer of 2 or greater. A position of the carriage is detected by reading a linear scale disposed along the moving direction of the carriage by means of a sensor mounted on the carriage. Typically, a device called a linear encoder is used. The inkjet printer includes a flat-plate platen having a width equal to or greater than a length of a nozzle array of the recording head. The inkjet printer causes the recording medium to be absorbed on the platen and keep flat, and ejects ink onto the recording medium, thereby recording an image. The inkjet printer keeps a recording medium flat and ejects ink onto the flat recording medium based on the position of the carriage measured by the linear encoder, so that it can record an image under stable conditions, thereby recording an image having high quality.

However, the recording medium supported by the platen may have a wrinkle, which may deteriorate quality of the recorded image, damage the recording head, or cause jam of the recording medium.

For example, Japanese Patent Application Publication No. 2012-228778 discloses a device including an ink head moving in a main scanning direction perpendicular to a conveying direction of a recording medium, a rotating member rotatably fixed, and a detection unit provided to the ink head and configured to detect rotation of the rotating member. The device detects proximity of a recording medium to the ink head by detecting rotation of the rotating member due to contact with the recording medium. If rotation is detected by the detection unit, the device stops movement of the ink head, thereby preventing the ink head from being damaged.

The above device detects, by detecting rotation of the rotating member, that the distance between the ink head and the recording medium has become equal to or less than a predetermined value, and performs processing such as stopping.

However, the rotating member is fixed near the ink head, so splattered ink or ink mist may adhere to a rotating part of the rotating member. If ink adheres to the rotating part, the ink may increase the force required to rotate the rotating member, or at worst, may solidify and lock the rotating member. These may cause erroneous detection or disable the detection. Control based on erroneous detection of the rotating member may cause fatal damage to the recording head.

SUMMARY OF THE INVENTION

An aspect of the present invention is intended to provide an inkjet printer capable of appropriately controlling a carriage.

According to an aspect of the present invention, there is provided an inkjet printer for recording an image on a recording medium, the inkjet printer including: a recording head including a plurality of nozzles and configured to eject ink from the plurality of nozzles to the recording medium; a flat-plate platen configured to support the recording medium; a conveying unit configured to convey the recording medium in a conveying direction; a carriage on which the recording head is mounted, the carriage being configured to move in a main scanning direction perpendicular to the conveying direction, the carriage having a side surface in the main scanning direction; a flexible detection plate disposed on the side surface of the carriage and spaced a predetermined distance from the platen in a direction in which the recording head and the platen face each other, the detection plate being configured to deform due to contact with the recording medium; at least one detection sensor fixed to the detection plate and configured to output a signal in response to deformation of the detection plate; a position sensor configured to detect a position of the carriage; and a controller configured to control operation of the carriage, the recording head, and the conveying unit, the controller being configured to, upon detecting contact of the recording medium with the detection plate based on the signal output by the at least one detection sensor while the carriage is moving, control operation of the carriage and the recording head based on a moving direction of the carriage and the position detected by the position sensor.

DETAILED DESCRIPTION OF THE INVENTION

An embodiment of the present invention will now be described with reference to the drawings.

Figure 1:
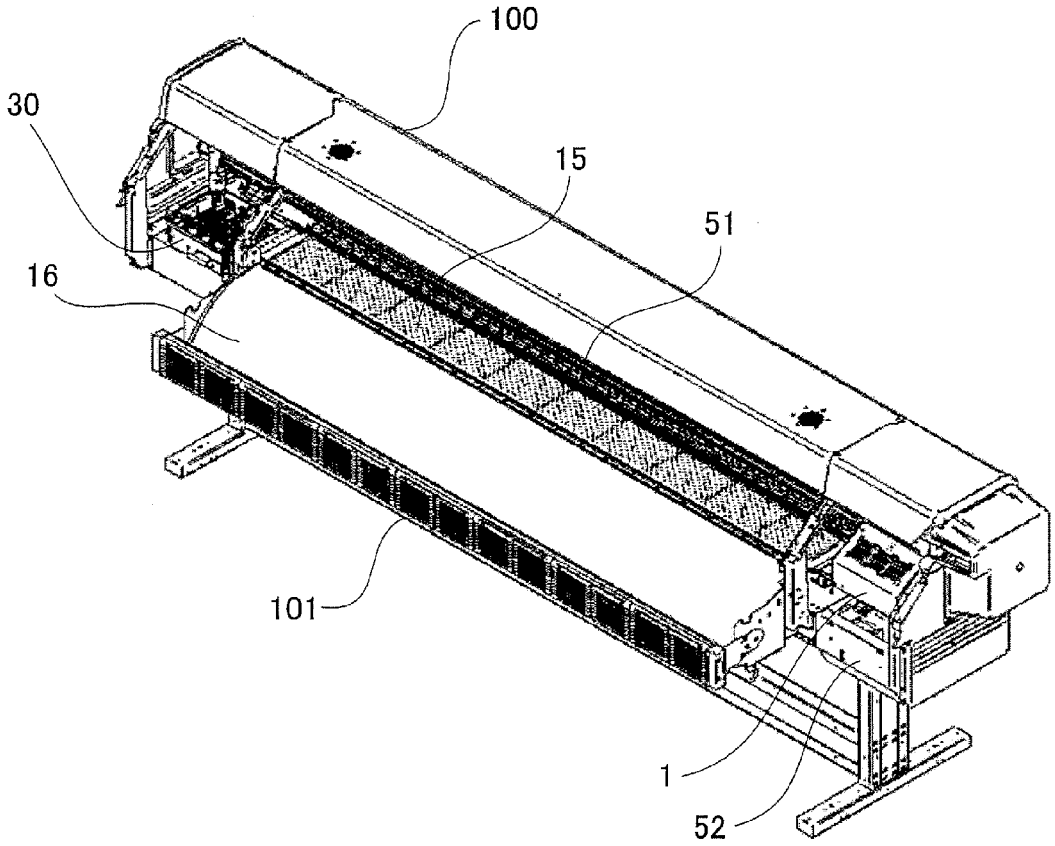
FIG. 1 is a schematic overall view of a printer.

FIG. 1 is a schematic overall view of an inkjet printer 100. In FIG. 1, the inkjet printer 100 includes a carriage 1, a platen 15, a rail 51, a paper guide 16, and an upper heater 101. The inkjet printer 100 ejects ink to a recording medium absorbed on the platen 15 while reciprocating the carriage 1 over the platen 15, thereby recording an image on the recording medium. The platen 15 is a flat plate and has pores formed therein. A suction chamber is disposed behind the platen 15. The inkjet printer 100 sucks air through the pores into the suction chamber and supports the recording medium by a force due to the air suction. The carriage 1 is movably mounted on the rail 51. The rail 51 is disposed along the platen 15. The rail 51 is disposed along a longitudinal direction of the inkjet printer 100, and the carriage 1 is movable along the rail 51. The recording medium is conveyed on the platen 15 in a conveying direction. The recording medium is conveyed by a recording medium conveying unit 21 (see FIG. 4). The recording medium conveying unit 21 includes a conveying roller for conveying the recording medium. The paper guide 16 is disposed downstream of the platen 15 in the conveying direction of the recording medium. The paper guide 16 heats the recording medium discharged from the platen 15 to accelerate ink fixing. The upper heater 101 is disposed facing the paper guide 16, and heats the recording medium to further accelerate ink fixing.

Figure 2:
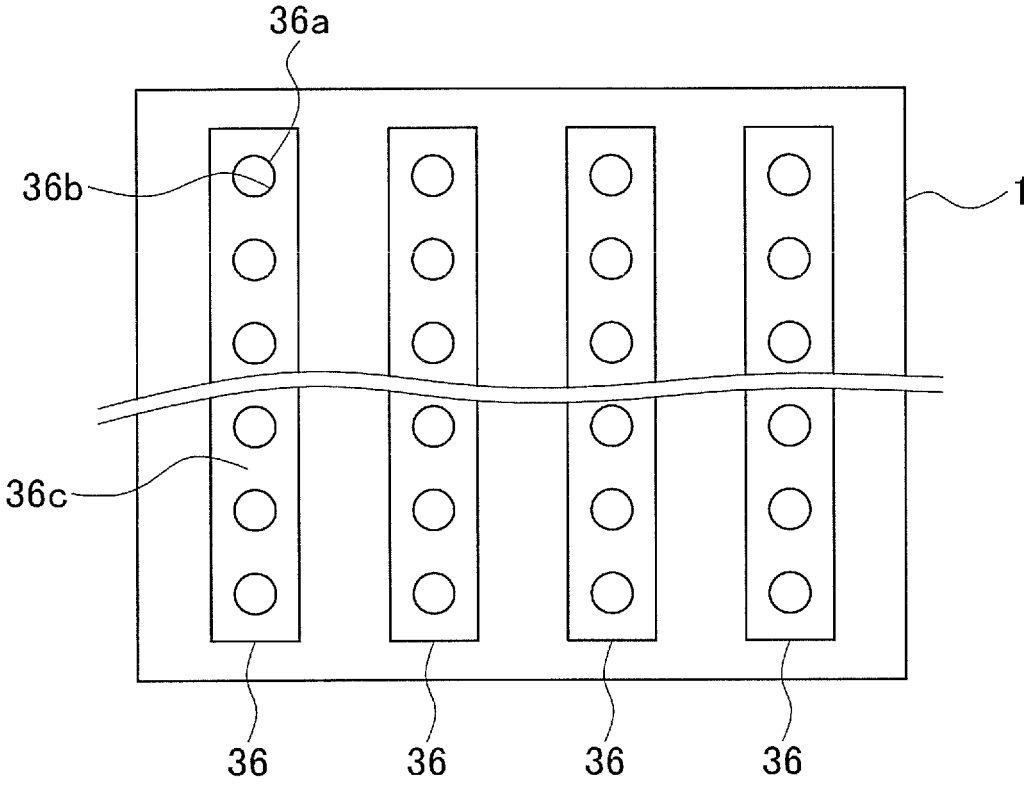
FIG. 2 is a schematic diagram of a carriage.

As illustrated in FIG. 2, multiple (here four) recording heads 36 are mounted on the carriage 1. Each of the recording heads 36 includes multiple nozzles 36*a* having openings 36*b* for ejecting ink, and also includes a nozzle surface 36*c* in which the openings 36*b* of the nozzles 36*a* are arranged. The recording heads 36 and nozzle surfaces 36*c* are disposed on a side of the carriage 1 facing the platen 15.

Referring to FIG. 1, the inkjet printer 100 also includes a wiping unit 30 for cleaning the recording heads 36 mounted on the carriage 1. The wiping unit 30 includes wipers 35 (see FIG. 5) for wiping the recording heads 36. The wiping unit 30 is disposed beside the platen 15. The inkjet printer 100 moves the carriage 1 to a position corresponding to the wiping unit 30 and moves the wiping unit 30 toward the carriage 1. At this time, the inkjet printer 100 controls raising and lowering of the wiping unit 30 so that the wiping unit 30 stops at a target position. The wiping unit 30 is raised to a position where the wipers 35 abut the nozzle surfaces 36*c* of the recording heads 36. The inkjet printer 100 can wipe and clean the nozzle surfaces 36*c* by moving the wipers 35.

The inkjet printer 100 also includes a capping unit 52 for capping the nozzle surfaces 36*c* of the recording heads 36.

Figure 3:
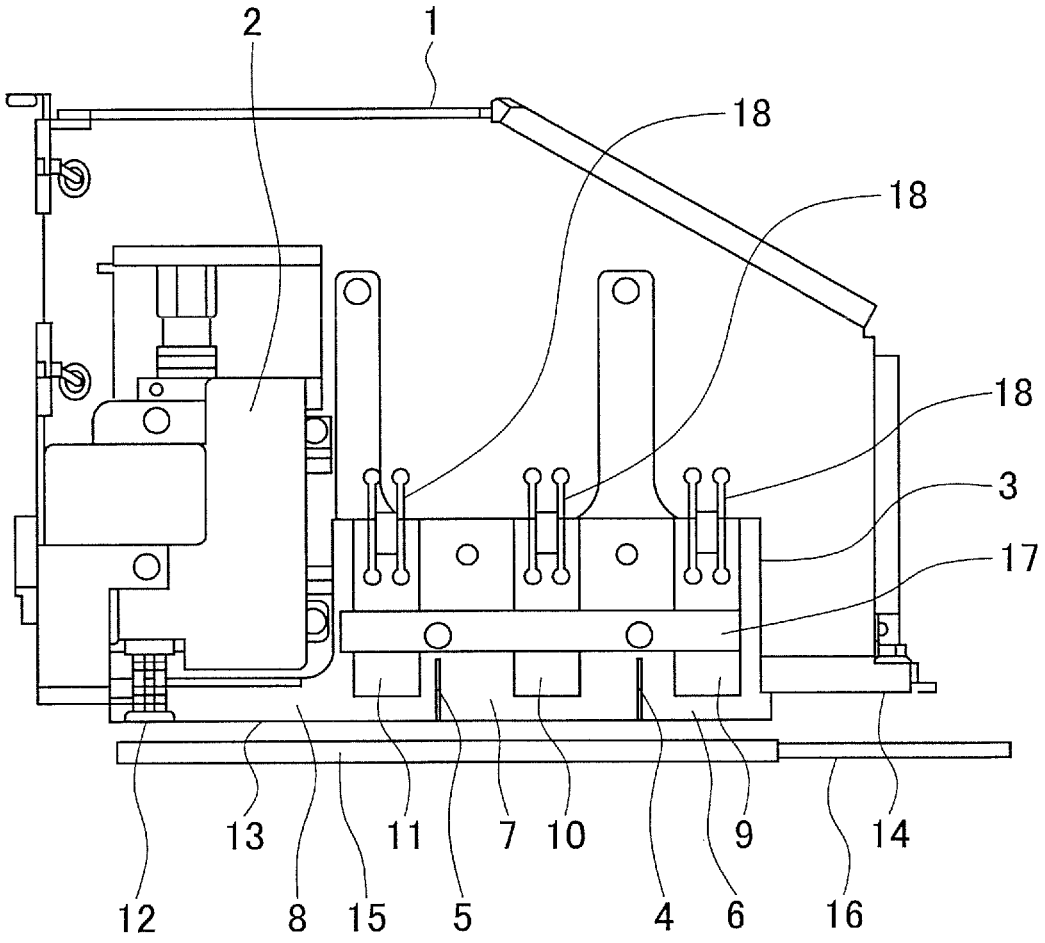
FIG. 3 is a side view of the carriage.

FIG. 3 is a side view of the carriage 1. Although the rail 51 is not illustrated in FIG. 3, the carriage 1 moves in the direction perpendicular to the drawing sheet of FIG. 3. Detection plates 3 are fixed to side surfaces of the carriage 1. The detection plates 3 are provided on both sides of the carriage 1, but only one of the detection plates 3 on one side will be described here. A first sensor 9, a second sensor 10, and a third sensor 11 as detection sensors are fixed to the detection plate 3. The first, second, and third sensors 9, 10, and 11 detect deformation, such as deflection or distortion, occurring in the detection plate 3 when the detection plate 3 comes into contact with a recording medium. For example, these sensors include piezoelectric elements, and generate electricity to output signals by being deformed.

The carriage 1 is provided with an up-and-down mechanism 2 for moving up and down the carriage 1 relative to the rail 51 in a direction in which the carriage 1 approaches and separates from the platen 15. Here, a direction in which the carriage 1 approaches the platen 15 will be referred to as the downward direction, and a direction in which the carriage 1 separates from the platen 15 will be referred to as the upward direction. With the up-and-down mechanism 2, it is possible to change the distance between the carriage 1 and the platen 15 or the recording medium supported on the platen 15 in the upward-downward direction. The carriage 1 is also provided with a distance sensor 12 for measuring a distance to the platen 15. A distance between the carriage 1 and the platen 15 or the recording medium can be determined by moving up and down the distance sensor 12 from a reference position and measuring the length of the movement of the distance sensor 12. For example, the detection plate 3 has an edge 13 facing the platen 15, and the reference position is a position of the edge 13. The detection plate 3 is provided for detecting the presence or absence of unevenness in the recording medium occurring due to wrinkles or twists of the recording medium. A distance from the edge 13 to the platen 15 or a recording medium without distortion in the upward-downward direction is first measured. The carriage 1 is scanned and output of the detection plate 3 is obtained. A thickness of a recording medium can be determined from the difference between a distance from the reference position to the platen 15 and a distance from the reference position to the recording medium.

When the detection plate 3 comes into contact with the recording medium, a signal is output from the detection plate 3. In this case, it can be seen that the recording medium has a projecting portion. When the detection plate 3 is not in contact with the recording medium, no signal is output from the detection plate 3. In this case, it can be seen that the recording medium has no projecting portion greater than the initially measured distance to the recording medium in the upward-downward direction.

A height or level of the carriage 1 (or a distance between the carriage 1 and the recording medium) affects image quality. It is undesirable that the nozzle surfaces 36*c* of the recording heads 36 are too far away from or too close to the recording medium, and the distance between the nozzle surfaces 36*c* and the recording medium needs to be a suitable distance. The recording heads 36 and nozzle surfaces 36*c* are behind the detection plate 3 and thus not illustrated in FIG. 3. It is necessary to move up and down the carriage 1 to set the distance between the reference position and the recording medium to a suitable distance. Further, to prevent the nozzle surfaces 36*c* from abutting the recording medium, it is preferable that in the upward-downward direction, the distance from the platen 15 to the edge 13 be equal to the distance from the platen 15 to the nozzle surfaces 36*c*. It is not very preferable that the nozzle surfaces 36*c* project relative to the edge 13.

The carriage 1 is provided with a guard 14, which is a reinforcing portion for protecting the carriage 1 when jam occurs. The guard 14 reinforces a part of the carriage 1 where a recording medium cannot be detected by the detection plate 3. The detection plate 3 needs to have at least a width corresponding to the recording heads 36, and preferably has a width corresponding to the platen 15. The first, second, and third sensors 9, 10, and 11 are connected by wiring 18, which is electrical wiring, to a controller 20 (see FIG. 4). The wiring 18 is placed in the carriage 1 and connected to the controller 20.

The edge 13 side of the detection plate 3 is divided by a first slit 4 and a second slit 5 into three pieces: a first plate piece 6, a second plate piece 7, and a third plate piece 8. The first, second, and third sensors 9, 10, and 11 are disposed on the first, second, and third plate pieces 6, 7, and 8, respectively. Each sensor responds to distortion of the corresponding plate piece. The detection plate 3 and sensors 9 to 11 are fixed to the carriage 1 by a fixing plate 17, which is disposed near ends of the slits 4 and 5 dividing the detection plate 3. Thereby, the detection can be performed individually for each plate piece. Although the plate pieces 6 to 8 may have the same width, they preferably have different widths. For example, a plate piece on the downstream side in the conveying direction of the recording medium has a smaller width, and a plate piece on the upstream side has a greater width. The frequency of occurrence of the unevenness varies with location, so it is preferable that the plate pieces have different widths corresponding to the frequencies at their locations. The conveying roller is disposed upstream of the carriage 1 in the conveying direction of the recording medium. The nearer the conveying roller, the less the unevenness, which may cause jam, is likely to occur.

The detection plate 3 is preferably made of polyethylene terephthalate (PET) resin having resistance to ink, high workability, and high durability. Regarding fixing the first, second, and third sensors 9, 10, and 11 to the detection plate 3, in view of replacement, each sensor may be inserted in a concave portion formed in the detection plate 3. The first, second, and third sensors 9, 10, and 11 may also be bonded to the detection plate 3.

In this example, the three sensors are used, but the detection plate 3 may be provided with one sensor. When multiple, e.g., three, sensors are used, it is possible to perform controls, such as stopping the carriage 1, if at least one of the sensors responds. Depending on the position at which a sensor is provided to the detection plate 3, a time lag may occur; the multiple sensors are arranged so as to improve the response.

Figure 4:
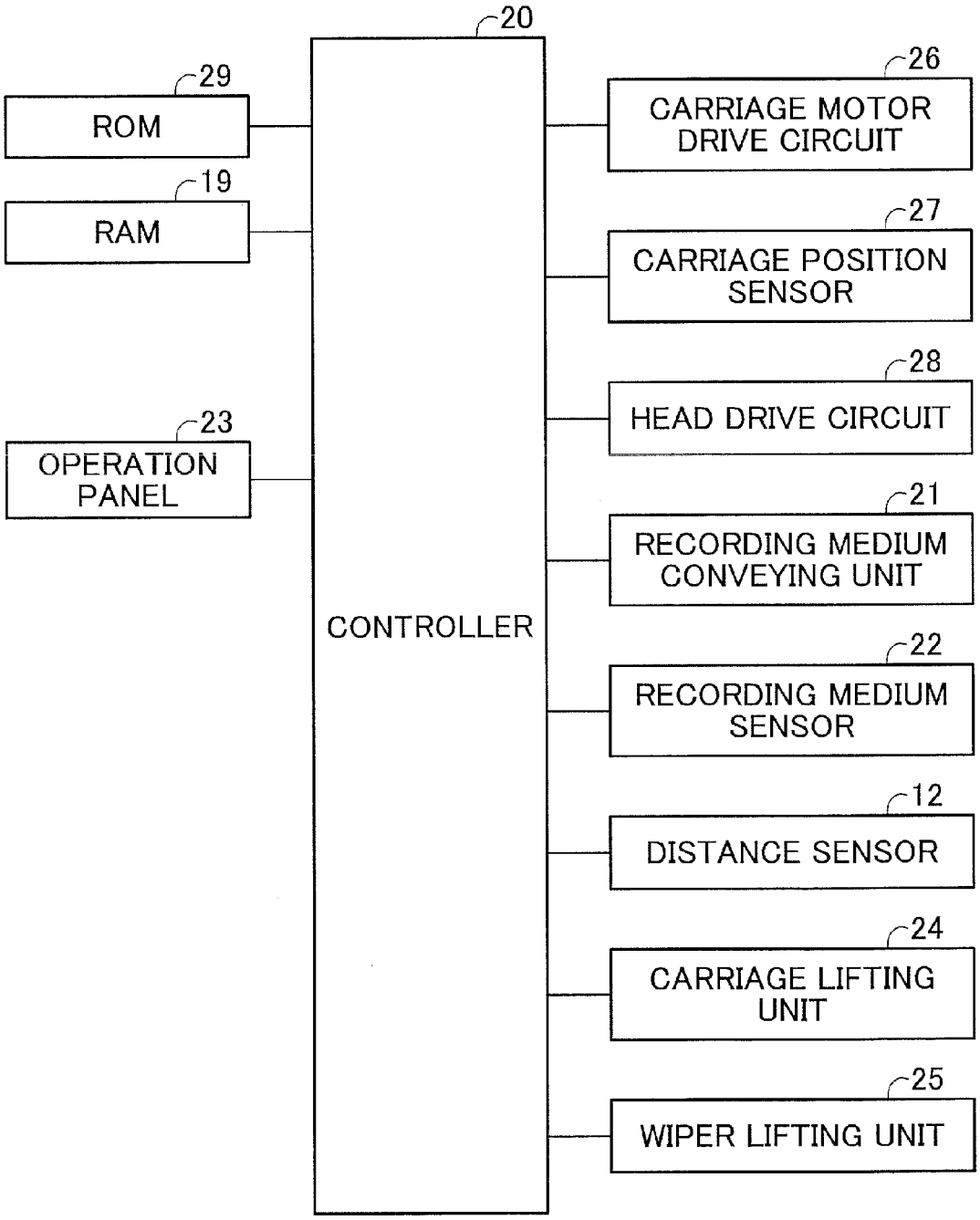
FIG. 4 is a block diagram of the printer.

FIG. 4 is a block diagram of the inkjet printer 100. In FIG. 4, the printer 100 includes the controller 20, a read only memory (ROM) 29, a random access memory (RAM) 19, a carriage motor drive circuit 26, a carriage position sensor 27, a head drive circuit 28, a recording medium conveying unit 21, a wiper lifting unit 25, a recording medium sensor 22, the distance sensor 12, an operation panel 23, and a carriage lifting unit 24. The controller 20 includes a central processing unit (CPU) that executes processing operations, such as calculation, control, determination, or setting. The controller 20 operates in accordance with a control program stored in the ROM 29. The RAM 19 is used as a buffer for recording data, a work area for processing by the controller 20, or the like. The carriage motor drive circuit 26 operates under control of the controller 20 and drives a motor for moving the carriage 1. The carriage position sensor 27 is a sensor for detecting the position of the carriage 1. The carriage position sensor 27 includes a linear sensor for detecting scale marks of a linear scale disposed along the rail 51, on which the carriage 1 is movably mounted. Based on output of the sensor, the position of the carriage 1 can be calculated and determined. The movement of the carriage 1 can be controlled based on the determined position.

The head drive circuit 28 is controlled by the controller 20. The controller 20 controls the head drive circuit 28 to drive the recording heads 36. The controller 20 and head drive circuit 28 can individually drive each of the recording heads 36. Based on information input from the controller 20, for each recording head 36, the head drive circuit 28 determines ejection times at which ink is to be ejected or non-ejection times at which ink is not to be ejected, and drives the recording head 36 based on the determined ejection times or non-ejection times. The ejection times or non-ejection times are calculated based on the position of the carriage 1 obtained by the carriage position sensor 27. For each recording head 36, the head drive circuit 28 generates an ON waveform when causing the recording head 36 to eject ink, generates an OFF waveform when causing the recording head 36 to eject no ink, and transmits the generated waveforms to the recording head 36. The ejection times are determined based on the position of the carriage 1.

The recording medium conveying unit 21 operates under control of the controller 20. The recording medium conveying unit 21 includes the conveying roller and a motor for driving the conveying roller. The motor drives the conveying roller to convey the recording medium.

The wiper lifting unit 25 operates under control of the controller 20. The wiper lifting unit 25 can move the wiping unit 30 in a direction in which the wiping unit 30 approaches the recording heads 36 and a direction in which the wiping unit 30 separates from the recording heads 36. For example, the wiper lifting unit 25 includes a cam 37 (see FIG. 6) for moving up and down the wiping unit 30, and a motor for driving the cam 37. The controller 20 controls the motor to rotate the cam 37 to move up and down the wiping unit 30.

The recording medium sensor 22 includes the first, second, and third sensors 9, 10, and 11 fixed to the detection plates 3 and the detection plates 3. The recording medium sensor 22 outputs signals in response to distortion of the detection plates 3. The recording medium sensor 22 operates under control of the controller 20. The recording medium sensor 22 is fixed to the carriage 1, so it can detect unevenness in a recording medium within a range of movement of the carriage 1.

The distance sensor 12 is fixed to the carriage 1. The distance sensor 12 includes an extendable contact having a leading end. The distance sensor 12 or controller 20 can move the leading end until the leading end comes into contact with an object (e.g., platen 15) and measure the distance of the movement of the leading end, thereby measuring the distance from the reference position to the object. The distance sensor 12 operates under control of the controller 20.

The operation panel 23 operates under control of the controller 20. The operation panel 23 includes a liquid crystal display (LCD) panel and is capable of displaying various information. The operation panel 23 also includes a keyboard and is capable of receiving input.

The carriage lifting unit 24 can move the carriage 1 in an approaching/separating direction relative to the platen 15. The approaching/separating direction is a direction in which the carriage 1 approaches and separates from the platen 15. The carriage lifting unit 24 operates under control of the controller 20. Based on a distance to an object obtained by the distance sensor 12, the controller 20 can control the carriage lifting unit 24 to raise and lower the carriage 1, thereby setting the distance between the carriage 1 and the platen 15 to a desired distance. By using the carriage lifting unit 24, in testing the recording medium sensor 22, it is possible to move the carriage 1 to a level at which the recording medium sensor 22 can abut detection projections 31, described later, for abutting the recording medium sensor 22.

The controller 20 controls functions of the inkjet printer 100.

Figure 5:
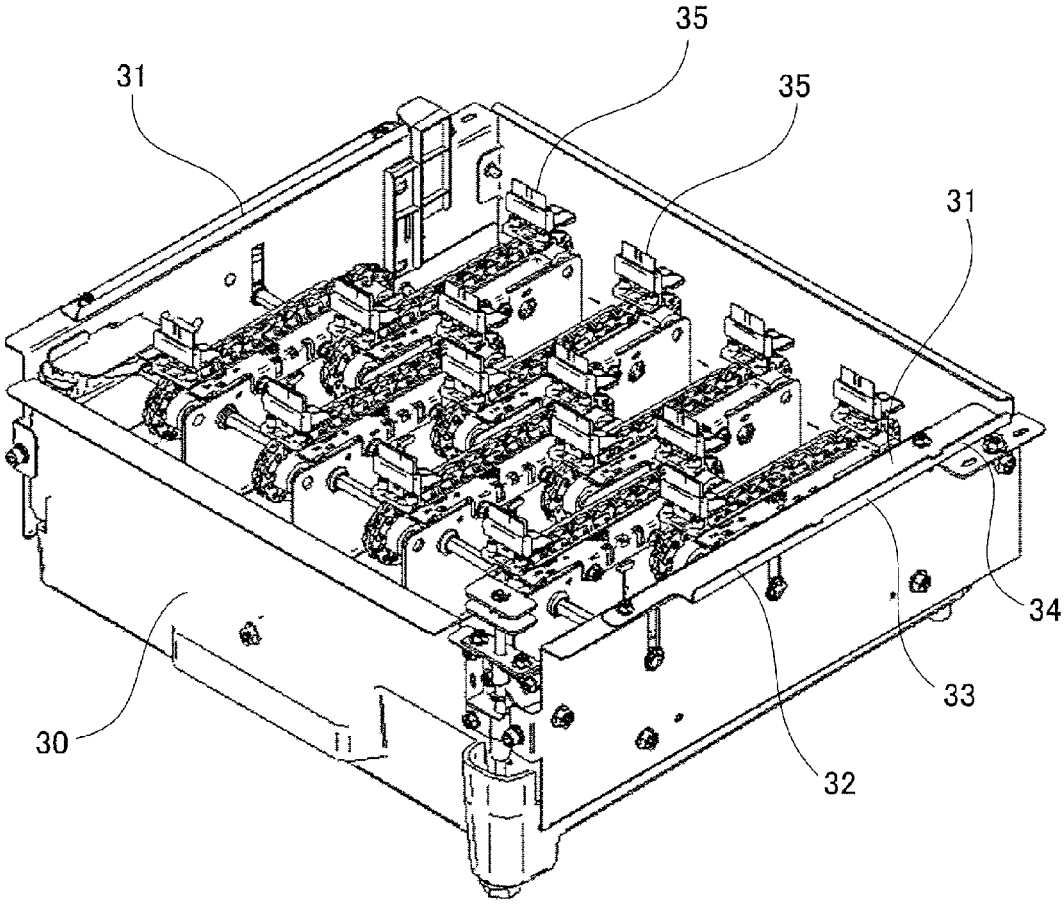
FIG. 5 is a view illustrating an example of a wiping unit for recording heads.

FIG. 5 is a view illustrating an example of the wiping unit (or maintenance unit) 30 for the recording heads 36. The nozzle surfaces 36*c* of the recording heads 36 are contaminated by ink mist or the like. The contamination of the nozzle surfaces 36*c* causes problems, such as nozzle clogging, non ejection, or deflected flight. It also causes a problem in that ink near nozzles 36*a* increases in viscosity and seeps without being ejected. Thus, the wiping unit 30 cleans the nozzle surfaces 36*c*. The wiping unit 30 includes wipers 35 for cleaning the nozzle surfaces 36*c* of the recording heads 36. Each of the wipers 35 corresponds to one of the recording heads 36. The wiping unit 30 regularly wipes the nozzle surfaces 36*c* by the wipers 35. Each of the wipers 35 is fixed to a belt and moved with rotation of the belt to wipe the corresponding nozzle surface 36*c*. Below the wipers 35 is disposed a tank containing cleaning liquid for cleaning the wipers 35. Each of the wipers 35 moves with rotation of the belt, is cleaned in the cleaning liquid, and is brought into contact with the nozzle surface 36*c* in a clean state.

The wiping unit 30 is raised and lowered by the wiper lifting unit 25. The wiping unit 30 is disposed beside the platen 15 and outside a recording area. The wiping unit 30 is normally located at a lower position where the wipers 35 cannot abut the recording heads 36. In wiping operation, the carriage 1 is moved over the wiping unit 30, and then the wiper lifting unit 25 is controlled to move the wiping unit 30 toward the carriage 1. Then, the belts are rotated to wipe the nozzle surfaces 36*c* by the wipers 35. Upon completion of the wiping operation, the rotation of the belts is stopped, and the wiping unit 30 is lowered.

In addition to the wipers 35, the wiping unit 30 is provided with the detection projections 31. The detection projections 31 are disposed at leading ends of side walls of the wiping unit 30 in a moving direction of the carriage 1. Operation of the detection plates 3 can be tested by causing the detection plates 3 to abut the detection projections 31. Since the wiping unit 30 can be moved up and down, the position of the detection projections 31 can be changed in a height direction (or the upward-downward direction). This enables the test to be performed at various positions. Each of the detection projections 31 is divided into a first projection 32, a second projection 33, and a third projection 34. The first projection 32 can test the first sensor 9 of the first plate piece 6; the second projection 33 can test the second sensor 10 of the second plate piece 7; the third projection 34 can test the third sensor 11 of the third plate piece 8. In this example, the leading edge of each of the detection projections 31 is divided corresponding to the sensors, but it need not necessarily be divided.

The detection projections 31 are disposed on both sides of the wiping unit 30 with a portion where the wipers 35 are disposed therebetween, but one of the detection projections 31 may be omitted. The detection plates 3 can be tested even when one detection projection 31 is disposed on only one side of the wiping unit 30.

The first projection 32, second projection 33, and third projection 34 are disposed at different positions in the moving direction of the carriage 1, and can individually test the corresponding sensors while the carriage 1 is being moved.

In this example, regarding an approaching/separating unit for causing the detection projections 31 and detection plates 3 to approach and separate from each other, a case where the detection projections 31 are provided to the wiping unit 30 has been described. In another example, the detection projections 31 are disposed on both sides outside the range of movement of the carriage 1. The carriage 1 is controlled so that only in the test, the carriage 1 moves to a position where the detection plates 3 abut the detection projections 31, but otherwise the carriage 1 does not move to a position where the detection plates 3 abut the detection projections 31. In this case, if there is no function for raising and lowering the detection projections 31, it is possible at least to test whether the sensors operate. In another example, the detection projections 31 of the wiping unit 30 are arranged so that the leading ends of the detection projections 31 are located on the same level as a surface of the platen 15 for supporting the recording medium. In this configuration, when the carriage 1 is moved, the detection projections 31 do not abut the detection plates 3 or recording heads 36. In the test, the carriage 1 is lowered by the carriage lifting unit 24 to a level at which the detection plates 3 can abut the detection projections 31. Then, by moving the carriage 1 along the rail 51 to cause the detection plates 3 to abut the detection projections 31, whether the recording medium sensor 22 can detect the detection projections 31 is tested. The use of the carriage lifting unit 24 can eliminate the need to raise and lower the wiping unit 30.

Figure 6:
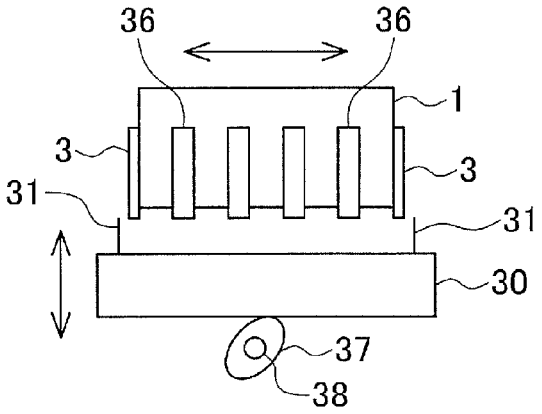
FIG. 6 is a diagram illustrating a test mechanism for a sensor.

FIG. 6 is a diagram illustrating a test mechanism for the sensor. The wiping unit 30 can be raised and lowered by rotating the cam 37. The cam 37 has a cam shaft 38 as a rotating shaft. The wiping unit 30 can be raised and lowered by driving the cam shaft 38 by the motor or the like. At this time, by controlling the angle of rotation of the cam 37, it is possible to stop the detection projections 31 at a desired position in the upward-downward direction or height direction relative to the detection plates 3. The recording heads 36 and detection plates 3, which are mounted on the carriage 1, are spaced from each other. Thus, by moving the wiping unit 30 based on accurate detection of the position of the carriage 1, it is possible to perform the test while controlling movement of the wiping unit 30 so that the detection projections 31 do not conflict with the recording heads 36. Each of the detection plates 3 disposed on both sides of the carriage 1 is tested. To accurately test the detection plates 3, it is preferable that the detection plates 3 abut the six detection projections at different times.

In this example, the wiping unit 30 is raised and lowered. However, the wiping unit 30 and carriage 1 may be relatively moved in the approaching/separating direction so that the detection projections 31 and detection plates 3 can abut each other. For example, the test can be performed by moving the carriage 1 toward the wiping unit 30 using the carriage lifting unit 24 with the wiping unit 30 fixed. Further, the detection projections 31 may be disposed where the detection projections 31 can be raised and lowered, or may be disposed at a place having a lower space into which the carriage 1 can be lowered. A recording medium is conveyed on the platen 15, so the platen 15 needs to be flat. Thus, the detection projections 31 are preferably disposed outside the platen 15 or recording area.

Figure 7:
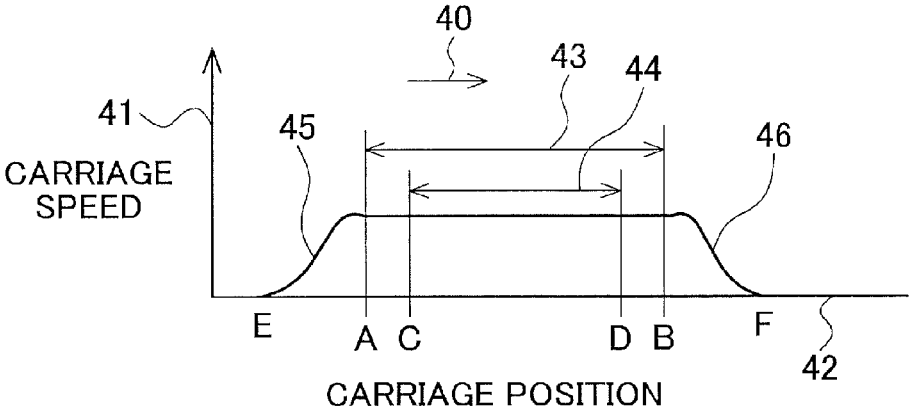
FIGS. 7 and 8 are diagrams illustrating the operation of the printer.
Figure 8:
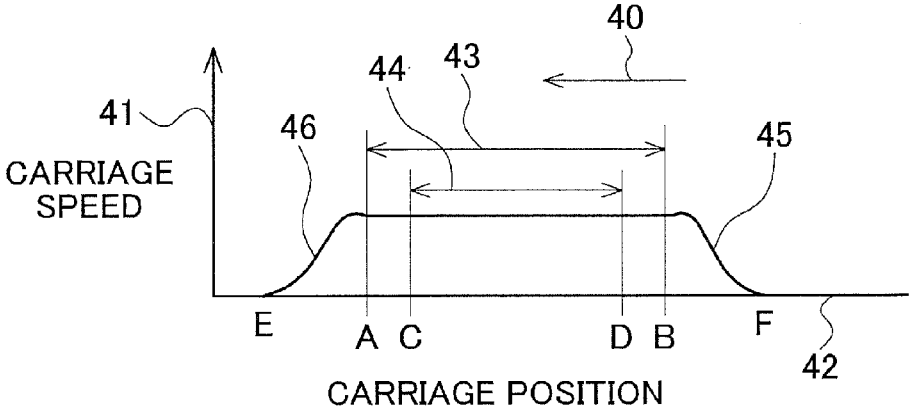

FIGS. 7 and 8 are diagrams illustrating the operation of the inkjet printer 100. The carriage 1 moves or reciprocates in a forward direction and a backward direction. FIG. 7 illustrates a motion of the carriage 1 on a forward path, i.e., when the carriage 1 moves in the forward direction. FIG. 8 illustrates a motion of the carriage 1 on a backward path, i.e., when the carriage 1 moves in the backward direction.

Each of FIGS. 7 and 8 has a horizontal axis 42 representing the position of the carriage 1 and a vertical axis 41 representing the speed of the carriage 1. In each of FIGS. 7 and 8, the carriage 1 first accelerates from rest to a predetermined speed, as indicated by reference character 45. The carriage 1 moves at a constant speed in a constant speed section 43 between positions A and B. The carriage 1 then decelerates and stops in a region outside position B or A, as indicated by reference character 46. After the stoppage, the carriage 1 starts to move in the opposite direction. The carriage 1 reciprocates in this manner. The constant speed section 43 includes a printing section 44 in which a recording medium is placed and subjected to printing. The printing section 44 is between positions C and D. In each of FIGS. 7 and 8, the direction of movement of the carriage 1 is indicated by arrow 40.

The motion of the carriage 1 on the forward path illustrated in FIG. 7 will be described. If the controller 20 detects contact of a recording medium with the detection plates 3 after the carriage 1 accelerates from rest and before the carriage 1 reaches position C (or while the carriage 1 moves from position E to position C), the controller 20 continues printing on the forward path and does not perform printing on the subsequent backward path. In this case, when the carriage 1 is stopped at the end of the forward path (or position F), the controller 20 raises the carriage 1; then, the controller 20 moves the carriage 1 to a position for capping, caps the nozzle surfaces 36*c* using the capping unit 52, and stops printing. If the controller 20 detects contact of a recording medium with the detection plates 3 after the carriage 1 reaches position C (or while the carriage 1 moves from position C to position F), the controller 20 performs printing on the subsequent backward path as usual, moves the carriage 1 to the position for capping, caps the nozzle surfaces 36*c* using the capping unit 52, and stops printing.

Next, the motion of the carriage 1 on the backward path illustrated in FIG. 8 will be described. If the controller 20 detects contact of a recording medium with the detection plates 3 after the carriage 1 is stopped and before the carriage 1 reaches position D (or while the carriage 1 moves from position F to position D), the controller 20 continues printing on the backward path as usual, moves the carriage 1 to the position for capping, caps the nozzle surfaces 36*c* using the capping unit 52, and stops printing. If the controller 20 detects contact of a recording medium with the detection plates 3 after the carriage 1 reaches position D (or while the carriage 1 moves from position D to position E), the controller 20 performs operation on the subsequent forward path. For example, if the controller 20 detects contact of a recording medium with the detection plates 3 in the operation on the subsequent forward path, the controller 20 moves the carriage 1 to the position for capping on the subsequent backward path in a state where the carriage 1 is raised, caps the nozzle surfaces 36*c* using the capping unit 52, and stops printing. When the carriage 1 is switched from the forward path to the backward path, the controller 20 stops the carriage 1, raises the carriage 1, and then moves the carriage 1 on the backward path. At this time, the carriage 1 is preferably raised to a maximum height.

When the controller 20 detects contact of a recording medium with the detection plates 3, it may promptly stop the carriage 1. However, it is preferable to control the motion of the carriage 1 and recording operation depending on the moving direction and position of the carriage 1, as described above. If the controller 20 stops the carriage 1 and stops printing halfway, the printed matter is not completed and it is difficult to resume the printing, so that the recording medium is discarded. Such a problem can be avoided by continuing printing until the currently scanned printing is finished. The control is performed to allow the printing to be resumed.

Further, the controller 20 determines, from detection by the carriage position sensor 27, a position of the carriage 1 where the recording medium comes into contact with the detection plates 3, displays the determined position on the operation panel 23, thereby informing a user of a wrinkle position.

It is possible to check the detection sensors by the detection projections 31 provided to the wiping unit 30 and display the result of the check on the operation panel 23. It is also possible to check the detection sensors while varying a relative distance between the detection projections 31 and the detection plates 3 by raising and lowering the carriage 1.

A recording medium is conveyed while being supported by the platen 15 and paper guide 16. It is possible to detect unevenness caused by distortion, bend, or the like of the recording medium and control stop and movement so as to prevent the recording heads 36 mounted on the carriage 1 from coming into contact with the recording medium.

The inkjet printer 100 can detect proximity of a recording medium to the recording heads 36 without using a rotating member, thereby preventing erroneous detection or detection impossibility and appropriately controlling the carriage 1.

According to the present embodiment, it is possible to, when a recording medium becomes too close to the carriage 1 on which the recording heads 36 are mounted, to change motion of the carriage 1, thereby preventing the recording heads 36 from being damaged and preventing jam from occurring.

The present invention is applicable to an inkjet printer.

The present invention is not limited to the embodiment described above; it can be practiced in various other aspects without departing from the invention scope.

For example, the number of recording heads 36 is not limited to four, and may be one, two, three, five or more.

What is claimed is:

1. An inkjet printer for recording an image on a recording medium, comprising:

a recording head including a plurality of nozzles and configured to eject ink from the plurality of nozzles to the recording medium;

a flat-plate platen configured to support the recording medium;

a conveying unit configured to convey the recording medium in a conveying direction;

a carriage on which the recording head is mounted, the carriage being configured to move in a main scanning direction perpendicular to the conveying direction, the carriage having a side surface in the main scanning direction;

a flexible detection plate disposed on the side surface of the carriage and spaced a predetermined distance from the platen in a direction in which the recording head and the platen face each other, the detection plate being configured to deform due to contact with the recording medium;

at least one detection sensor fixed to the detection plate and configured to output a signal in response to deformation of the detection plate;

a position sensor configured to detect a position of the carriage; and a controller configured to control operation of the carriage, the recording head, and the conveying unit, the controller being configured to, upon detecting contact of the recording medium with the detection plate based on the signal output by the at least one detection sensor while the carriage is moving, control operation of the carriage and the recording head based on a moving direction of the carriage and the position detected by the position sensor.

2. The inkjet printer of claim 1, wherein the detection plate has at least one slit extending from a side facing the platen toward a side opposite to the platen, the detection plate having an edge facing the platen, the edge being divided by the at least one slit into a plurality of parts, at least one of the at least one detection sensor being disposed in each of the plurality of parts.

3. The inkjet printer of claim 1, wherein:

the carriage is configured to reciprocate in a forward direction and a backward direction, and a control performed by the controller upon detecting contact of the recording medium with the detection plate based on the signal output by the at least one detection sensor while the carriage is moving in the forward direction is different from a control performed by the controller upon detecting contact of the recording medium with the detection plate based on the signal output by the at least one detection sensor while the carriage is moving in the backward direction.

4. The inkjet printer of claim 1, wherein:

the carriage is configured to reciprocate in a forward direction and a backward direction, and the controller is configured to, upon detecting contact of the recording medium with the detection plate based on the signal output by the at least one detection sensor, stop the carriage when the moving direction of the carriage is changed between the forward direction and the backward direction, raise the carriage, and then restart movement of the carriage.

5. The inkjet printer of claim 1, wherein the controller is configured to, upon detecting contact of the recording medium with the detection plate based on the signal output by the at least one detection sensor, determine a position of the carriage and display the determined position on an operation panel.

* * * * *